United States Patent [19]

Maruyama et al.

[11] Patent Number: 5,045,178

[45] **Date of Patent: * Sep. 3, 1991**

[54] PROCESS FOR PRODUCTION OF METHYLNAPHTHALENES

[75] Inventors: Fumio Maruyama; Shirou Aizawa, both of Toda City; Kazuo Fujiyoshi, Tokyo, all of Japan

[73] Assignee: Nippon Mining Co., Ltd., Tokyo, Japan

[ * ] Notice: The portion of the term of this patent subsequent to Oct. 16, 2007 has been disclaimed.

[21] Appl. No.: 491,033

[22] Filed: Mar. 9, 1990

[30] Foreign Application Priority Data

Mar. 20, 1989 [JP] Japan ..... 1-66091

[51] Int. Cl.[5] ..... C10G 35/085

[52] U.S. Cl. ..... 208/138; 208/135; 208/136; 585/477; 585/804; 585/812; 585/828

[58] Field of Search ..... 208/135, 136, 138; 585/477, 804, 812, 828

[56] References Cited

U.S. PATENT DOCUMENTS

| | | | |
|---|---|---|---|
| 3,870,745 | 3/1975 | Angstadt | 585/471 |
| 3,890,403 | 6/1975 | Shimado et al. | 585/481 |
| 3,936,509 | 2/1976 | Nagahame et al. | 585/866 |
| 4,014,949 | 3/1977 | Hedge | 585/831 |
| 4,300,008 | 11/1981 | McCawlay | 208/134 |
| 4,536,278 | 8/1985 | Tatterson et al. | 208/89 |

FOREIGN PATENT DOCUMENTS

| | | |
|---|---|---|
| 230736 | 10/1987 | Japan . |
| 230737 | 10/1987 | Japan . |

*Primary Examiner*—Curtis R. Davis

*Attorney, Agent, or Firm*—Oliff & Berridge

[57] ABSTRACT

A process for producing methylnaphthalenes is disclosed, comprising subjecting a fraction containing at least 50% by volume of components within the boiling range of 195°-215° C., which is obtained by distilling a raffinate resulting from the recovery of normal paraffins from a hydrodesulfurized kerosene fraction, to reforming reaction and then recovering methylnaphthalenes from the product oil.

9 Claims, No Drawings

PROCESS FOR PRODUCTION OF METHYLNAPHTHALENES

BACKGROUND OF THE INVENTION

1. Field of the Invention

The present invention relates to a process for production of methylnaphthalenes from a raffinate resulting from recovery of normal paraffins from a kerosene fraction.

2. Related Art Statement

Methylnaphthalenes can be used as solvent, dye-carrier, heat transfer medium and the like and besides reacted with methanol to produce 2,6-dimethylnaphthalene. This 2,6-dimethylnaphthalene is used as a starting material for production of polyesters such as polyethylene naphthalates and the like. These polyesters can be formed into synthetic fibers and films having excellent characteristics.

Methylnaphthalenes are contained in coal tar or cycle oils in a fluid catalytic cracking process, but these cycle oils contain a high concentration of contaminants such as sulfur and nitrogen compounds and so on.

By the way, when producing 2,6-dimethylnaphthalene which is the monomer of said polyesters, methylnaphthalene having a high purity, particularly a low concentration of the above-described contaminants is desired for the reason of deactivation of catalyst, inhibition of by-product, increase in yield and the like.

With respect to nitrogen compound among these contaminants, a process for eliminating it by acid, alkali cleaning or the like is performed. Further, with respect to sulfur compound, there is proposed a process for refining the oil by recrystallization, fusing crystallization or the like after heat-treating with anhydrous aluminum chloride (see JP-A-62-230736 and JP-A-62-230737 (the term "JP-A" as used herein means an "unexamined published Japanese patent application")).

In the process for cleaning the oil with acid and alkali, however, it is impossible to sufficiently eliminate the sulfur compound and also a problem is in the disposal of used acid and alkali.

On the other hand, even in the process for refining the oil with anhydrous aluminum chloride, it is impossible to decrease the sulfur compound content to the extent that the deactivation of catalyst can sufficiently be inhibited and also a problem is in the waste disposal.

Further, when directly subjecting coal tar, cycle oils in a fluid catalytic cracking process or fractions thereof to a hydrorefining process in order to eliminate the above-described contaminants, the hydrogenation of the nucleuses of methylnaphthalenes can not be avoided, resulting in a great reduction in yield of methylnaphthalenes. Therefore, additional dehydrogenation is needed and a problem arises in that the production cost is markedly increased.

Normal paraffins are recovered from a kerosene fraction as a starting material for production of linear alkylbenzene sulfonates (LAS) as synthetic detergents, and the like, but the remaining raffinate after recovery of normal paraffins has a comparatively high smoking point and thus is not preferred as a fuel kerosene.

The inventors have made various investigations in order to solve such problems and as a result found that a product oil obtained by reforming reaction of a particular fraction of the above-described raffinate contains a large amount of methylnaphthalenes, from which can be recovered methylnaphthalenes having such a high purity that they are almost free from nitrogen and sulfur compounds by separation.

Incidentally, it is reported that catalytic reforming of a kerosene fraction provides heavy aromatic compounds and that the heavy aromatic compounds contain methylnaphthalenes (Sekiyu Gakkaishi, Vol. 13, No. 6 (1970), pp. 468–474). But, it has astonishingly been found that the reforming reaction of a particular fraction of the raffinate results in a great increase in an amount of the resulting methylnaphthalenes, as compared with the reforming reaction of the kerosene fraction. The present invention is based on such a discovery.

SUMMARY OF THE INVENTION

An object of the present invention provides a process in which methylnaphthalenes with a very low content of sulfur and nitrogen compounds can be produced at low cost, in high yield and without causing a problem of waste disposal.

That is, the present invention relates to a process for producing methylnaphthalenes which comprises subjecting a fraction containing at least 50% by volume of components within the boiling range of 195°–215° C., which is obtained by distilling a raffinate resulting from recovery of normal paraffins from a hydrodesulfurized kerosene fraction, to reforming reaction and then recovering methylnaphthalenes from the product oil.

DETAILED DESCRIPTION OF THE INVENTION

The hydrodesulfurized kerosene fraction as above-described is a distillate within the boiling range of 150°–300° C. As such a kerosene fraction, use may be made of the straight run kerosene fraction obtained by atmospheric distillation and fractions within the above-described boiling range which are obtained by subjecting each fraction of petroleum and residue thereof to thermal cracking, catalytic cracking, hydrocracking, alkylation and the other refining process. This kerosene fraction can be subjected to desulfurization under the commonly used hydrodesulfurization conditions, for example, with catalysts prepared by supporting at least one of cobalt, nickel, molybdenum, tungsten and the like on a carrier such as alumina or silica-alumina and under conditions of temperature range of 250°–430° C., pressure range of 10–200 kg/cm$^2$, liquid hourly space velocity (LHSV) range of 0.1–15 h$^{-1}$ and hydrogen recycle amount range of 50–1,400 Nm$^3$/kl. A kerosene fraction with reduced sulfur and nitrogen contents to 50 ppm or less is preferably used.

The raffinate is resulted from recovery of normal paraffins from the above-described hydrodesulfurized kerosene fraction. The recovery of normal paraffins can be carried out by adsorption separation using a molecular sieve, such as by the Iso-Siv method (cf. *Hydrocarbon Processing*, 59, No. 5, May, 1980, pp. 110–114), the Molex method (cf. D. B. Broughton et al., *Petrol. Refiner.*, 40(5), 173 (1961), and the BP method (cf. A. A. Yeo et al., *Six World Petroleum Congress*, Sect. IV-Paper 15 (1963)), or by separation using an urea adduct method. Use may advantageously be made of raffinates as by-products resulted from a process in which normal paraffins are produced as a starting material for production of synthetic detergents. As the raffinates, those in which at least 50% by weight, particularly 70–95% by weight, of normal paraffins in the kerosene fraction are recovered are preferred from the viewpoint of high yield of methylnaphthalenes.

In the present invention, the fraction containing at least 50% by volume of components within the boiling range of 195°-215° C., which is obtained by distilling the above-described raffinate, is used. If the content of the components within the same boiling range is less than 50% by volume, the production of methylnaphthalenes is small and its concentration is low, resulting in a great burden in separation process and a deterioration of production efficiency of methylnaphthalenes.

For the reforming reaction, a catalytic reforming process which is widely used for production of high-octane value gasoline from a naphtha fraction and so on can be employed. In this case, this can be carried out by the use of, e.g. a catalyst prepared by supporting platinum alone or in combination with rhenium, germanium, tin, iridium, ruthenium or the like on a carrier of alumina and under conditions of temperature range of 400°-550° C., pressure range of 1-50 kg/cm$^2$, liquid hourly space velocity (LHSV) range of 0.1-3 hr$^{-1}$ and hydrogen/oil molar ratio range of 0.5-20.

In another embodiment, the reforming reaction can be carried out by the use of a molecular sieve, or crystalline aluminosilicate, silica, alumina, zirconia, titania, chromia, solid phosphoric acid, or oxides of indium, lanthanum, manganese, cerium or tin, or acidic refractories containing a mixture of two or more thereof, or catalysts prepared by containing therein or supporting thereon metals such as platinum, palladium, and rhenium and under conditions of temperature range of 250°-700° C., pressure range of 1-100 kg/cm$^2$, LHSV range of 0.1-20 hr$^{-1}$, and hydrogen/oil molar ratio range of 0.5-20.

A reaction equipment provided with a reactor of fixed bed may be employed for the above-described reforming reaction, but it is preferred from the viewpoint of efficiency that a reaction equipment provided with a reactor of moving bed to which a continuous process for regeneration of catalysts is added is employed.

The product oil obtained as the above-described after the reforming reaction contains a relatively high concentration of methylnaphthalenes, and thus the methylnaphthalenes are recovered by techniques such as distillation, solvent extraction, conventional crystallization, high-pressure crystallization (cf. Kagaku Kogaku, 51, No. 6, 428-433 (1987)) and combinations thereof. The recovery by atmospheric distillation is preferred from the economic standpoint, and by collecting a 230°-250° C. fraction, a high concentration of methylnaphthalenes can be obtained.

In accordance with the present invention, methylnaphthalenes are recovered from a product oil resulting from the reforming reaction of a fraction containing particular components obtained by distilling a raffinate resulting from recovery of normal paraffins from a hydrodesulfurized kerosene fraction, so that methylnaphthalenes with a very low content of sulfur and nitrogen compounds can be produced at low cost, in high yield and without causing a problem of waste disposal.

The present invention is described in greater detailed with reference to the following examples.

EXAMPLES 1-2, COMPARATIVE EXAMPLES 1-2

A desulfurized kerosene fraction having properties as shown in Table 1, as obtained by hydrodesulfurization of a kerosene fraction, a raffinate as obtained by recovering 90% by weight of normal paraffins from the above-described kerosene fraction by the use of a molecular sieve, a raffinate fraction with the boiling range of 230° C. or less as obtained by subjecting the above-described raffinate to a true boiling point distillation, and a raffinate fraction with the boiling range of 190°-220° C. as obtained by the same distillation, were used as starting materials and subjected to reforming reaction by the use of a catalytic reforming catalyst comprising an alumina carrier having supported thereon 0.2% by weight of platinum and under the conditions of pressure of 25 kg/cm$^2$, temperature of 490° C., LHSV of 0.8 hr$^{-1}$, and hydrogen/oil molar ratio of 6. Properties of the product oil and the methylnaphthalene content are shown in Table 2. The product oil was subjected to atmospheric distillation and a 230°-250° C. fraction was collected, with the result that the purity of methylnaphthalenes was 93%.

TABLE 1

| Type of oil | | Desulfurized kerosene | Raffinate | Raffinate | Raffinate |
|---|---|---|---|---|---|
| Fraction | | all fractions | all fractions | 230° C. or less fractions | 190-220° C. fractions |
| Specific gravity (15/4° C.) | | 0.7926 | 0.8026 | 0.7984 | 0.8013 |
| Total nitrogen content (ppm) | | 0.5 or less | 0.5 or less | 0.5 or less | 0.5 or less |
| Sulfur content (ppm) | | 0.1 or less | 0.1 or less | 0.1 or less | 0.1 or less |
| Composition (vol %) | Saturated | 93.5 | 88.1 | 87.9 | 88.1 |
| | Unsaturated | 0.5 | 0.7 | 0.6 | 0.6 |
| | Aromatic | 6.0 | 11.2 | 11.5 | 11.3 |
| Distillation properties | Initial distillation point (°C.) | 181.5 | 188.0 | 188.0 | 190.5 |
| | 50% Distillation point (°C.) | 210.5 | 211.0 | 203.0 | 205.5 |
| | 95% Distillation point (°C.) | 243.0 | 242.5 | 225.0 | 215.0 |
| | End point (°C.) | 256.0 | 257.5 | 235.0 | 225.0 |
| 195-215° C. Component content (vol %) | | 31 | 35 | 51 | 72 |
| Methylphthalate content (wt %) | | 0 | 0 | 0 | 0 |

TABLE 2

| | | | Example 1 | Example 2 | Comparative Example 1 | Comparative Example 2 |
|---|---|---|---|---|---|---|
| Type of oil | | | Raffinate | Raffinate | Desulfurized kerosene | Raffinate |
| Fraction | | | 230° C. or less fraction | 190–220° C. fraction | All fractions | All fractions |
| Properties of product oil | Specific gravity (15/4° C.) | | 0.8721 | 0.8756 | 0.8683 | 0.8802 |
| | Total nitrogen content (ppm) | | 0.5 or less | 0.5 or less | 0.5 or less | 0.5 or less |
| | Sulfur content (ppm) | | 0.1 or less | 0.1 or less | 0.1 or less | 0.1 or less |
| | Composition (vol %) | Saturated | 33.5 | 31.3 | 38.2 | 35.3 |
| | | Unsaturated | 0.3 | 0.2 | 0.9 | 0.2 |
| | | Aromatic | 66.2 | 68.5 | 61.3 | 64.5 |
| | Distillation properties | Initial distillation point (°C.) | 45.0 | 44.0 | 42.0 | 41.0 |
| | | 50% distillation point (°C.) | 163.0 | 167.0 | 182.0 | 190.0 |
| | | 95% distillation point (°C.) | 278.0 | 270.0 | 289.0 | 298.0 |
| | | End point (°C.) | 288.0 | 282.0 | 305.0 | 308.0 |
| Composition (vol %) | 1-methylnaphthalene | | 4.1 | 5.3 | 1.9 | 2.5 |
| | 2-methylnaphthalene | | 10.4 | 13.3 | 4.6 | 6.4 |

As apparent from the foregoing results, by reforming reaction of a particular fraction of a raffinate resulting from recovery of normal paraffins from a kerosene fraction, methylnaphthalenes can be obtained in high yield, as compared with those from the kerosene fraction and the raffinate.

While the invention has been described in detail and with reference to specific embodiments thereof, it will be apparent to one skilled in the art that various changes and modifications can be made therein without departing from the spirit and scope thereof.

What is claimed is:

1. A process for producing methylnaphthalenes which comprises subjecting a fraction containing at least 50% by volume of components within the boiling range of 195°–215° C., which is obtained by distilling a raffinate resulting from recovery of normal paraffins from a hydrodesulfurized kerosene fraction, to reforming reaction and then recovering methylnaphthalenes from the product oil.

2. The process as claimed in claim 1, wherein the kerosene fraction with reduced sulfur and nitrogen contents to 50 ppm or less is used.

3. The process as claimed in claim 1, wherein the raffinate is a raffinate resulting from the recovery of at least 50% by weight of normal paraffins from a hydrodesulfurized kerosene fraction.

4. The process as claimed in claim 1, wherein the reforming reaction is carried out by the use of a catalyst prepared by supporting platinum alone or in combination with rhenium, germanium, tin, iridium, or ruthenium on an alumina carrier and under conditions of temperature range of 400°–550° C., pressure range of 1–100 kg/cm$^2$, liquid hourly space velocity range of 0.1–3 hr$^{-1}$, and hydrogen/oil molar ratio range of 0.5–20.

5. The process as claimed in claim 1, wherein the reforming reaction is carried out by the use of a molecular sieve, or crystalline aluminosilicate, silica, alumina, zirconia, titania, chromia, solid phosphoric acid, or oxides of indium, lanthanum, manganese, cerium or tin, or acidic refractories containing a mixture of two or more thereof, or catalysts prepared by containing therein or supporting thereon metals selected from platinum, palladium, and rhenium and under the conditions of temperature range of 250°–700° C., pressure range of 1–100 kg/cm$^2$, liquid hourly space velocity range of 0.1–20 hr$^{-1}$, and hydrogen/oil molar ratio range of 0.5–20.

6. The process as claimed in claim 1, wherein the recovery of methylnaphthalenes is carried out by distillation, solvent extraction, conventional crystallization or high-pressure crystallization, or combination thereof.

7. The process as claimed in claim 6, wherein the recovery of methylnaphthalenes is carried out by distillation to collect a 230°–250° C. fraction.

8. The process as claimed in claim 1, wherein the hydrodesulfurized kerosene fraction is a kerosene fraction with reduced sulfur and nitrogen contents to 50 ppm or less.

9. The process as claimed in claim 1, wherein a reaction equipment provided with a reactor of moving bed to which a continuous process for regeneration of catalysts is added is employed for the reforming reaction.

* * * * *